United States Patent [19]

Harada et al.

[11] 4,187,330

[45] Feb. 5, 1980

[54] ELECTROSTATIC DEVELOPING METHOD AND APPARATUS USING CONDUCTIVE MAGNETIC TONER

[75] Inventors: Hideki Harada, Urawa; Keitarou Yamashita, Kamisatomachi, both of Japan

[73] Assignee: Hitachi Metals, Ltd., Japan

[21] Appl. No.: 762,268

[22] Filed: Jan. 25, 1977

[30] Foreign Application Priority Data

Jan. 30, 1976 [JP] Japan ..... 51-8430
Feb. 4, 1976 [JP] Japan ..... 51-10405

[51] Int. Cl.[2] ..... G03G 15/09

[52] U.S. Cl. .....430/103; 118/651; 430/122
118/651; 430/122

[58] Field of Search ..... 96/1 R, 1 S, 1 D; 252/62.1 P, 62.51; 427/18; 118/657

[56] References Cited

U.S. PATENT DOCUMENTS 3,124,457 3/1964 Schwertz ..... 252/62.1 P X

FOREIGN PATENT DOCUMENTS 2538122 3/1976 Fed. Rep. of Germany ..... 252/62.1

*Primary Examiner*—John D. Welsh
*Attorney, Agent, or Firm*—Craig and Antonelli

[57] ABSTRACT

A method for developing an electrostatic latent image and an apparatus therefor, in which a magnetic toner layer is formed on an arcuate face formed from an insulator, and an electrostatic latent image carrying medium is supported such that its electrostatic latent image surface contacts lightly with a part of said magnetic toner layer.

14 Claims, 5 Drawing Figures

ELECTROSTATIC DEVELOPING METHOD AND APPARATUS USING CONDUCTIVE MAGNETIC TONER

This invention relates to a method of developing an electrostatic latent image by contacting the toner or developer with an electrostatic latent image carrying medium such as a sensitive plate or sensitive paper which is coated with photoconductive materials or dielectric materials, and an apparatus used in practicing such method.

There has been popularly employed an electrostatic developing method in which a two-component developer prepared by adhering the toner particles on the surfaces of the carrier particles is contacted with the electrostatic latent image and the toner particles alone are deposited on the image portion. Such method is disclosed, for instance, in U.S. Pat. No. 3,641,980 (inventor: John T. Bickmore). In this method, both carrier and toner particles are of high electric resistance, and before used for development, they are well mixed up and electrically charged such that they hold the electrostatic charges of opposite polarities to each other so that the toner particles adhere on the carrier particles. This mixed developer is deposited on a non-magnetic sleeve rotating around a permanent magnet and is carried close to the sensitive plate bearing the latent image thereon with the rotation of said permanent magnet or non-magnetic sleeve. As the carrier particles contain ferromagnetic particles or are of ferromagnetic nature as a whole, a magnetic brush of developer is formed in the vicinity of the sensitive plate by said permanent magnet, and this magnetic brush rubs on the sensitive plate in accordance with the rotation of said permanent magnet or non-magnetic sleeve, allowing the toner particles to be selectively attached on the latent image formed on the sensitive plate. The same phenomenon occurs when a sensitive paper is used instead of the sensitive plate.

The toner particles deposited on the sensitive plate or sensitive paper are fixed in a suitable way immediately or after having been transferred to other paper. There are two types of method for fixation: heat fixation where the toner particles on the paper are fixed under heating and pressure fixation where pressure is applied for effecting fixation. These methods may be selectively used depending on the type of binder or resin material contained in the toner particles.

As improvements over the above-described developing method using a two-component developer, there have been recently devised new developing methods using the electroconductive toner. Typical examples of such new methods and apparatus are revealed, for example, in U.S. Pat. No. 3,909,258 (inventor: Arthur R. Kotz) and U.S. Pat. No. 3,816,840 (inventor: Arthur R. Kotz). According to these methods, no ferromagnetic carrier particles are used for the development, and instead, the conductive toner particles containing a ferromagnetic material are deposited on a conductive sleeve having a permanent magnet disposed therein and are carried into the developing station to form a magnetic brush in this station. Since conductive paths are formed between the toner particles and the conductive sleeve and also said conductive sleeve is normally grounded to the copying machine frame, electric charges of opposite polarity to the electrostatic charges on the sensitive plate are induced on the toner brush by dint of the electric field created by the electrostatic charges on said sensitive plate. Thus, if the latent image on the sensitive plate is negatively charged, the positive charges gather around the toner particles on the magnetic brush. Such positive charges are attracted to the toner particles through the conductive sleeve as the toner on the magnetic brush is grounded.

However, constant formation of the conductive paths by use of a conductive sleeve obliges structural complication of the rotary sleeve, particularly when it houses therein a rotating permanent magnet. Also, since the great amount of toner particles adhering on the conductive sleeve have electric paths relative to each other, if the toner particles in a certain area are strongly charged to one polarity, those in the other area may come to be charged to the opposite polarity, and in some cases, these oppositely charged toner particles could repel the latent image on the sensitive plate, resulting in unsatisfactory deposition of the toner particles on the latent image. Further, this conductive toner developing method, as compared with the developing method using a two-component developer, has a disadvantage that the electrostatic latent image forming conditions for obtaining a high-quality picture, such as for example the exposure conditions, are restricted within a narrow range of selection. (This is considered attributable to the fact that the electric charges of the magnetic toner particles are induced by availing of their conductivity). In order to overcome such defect, a method was proposed in which a self-biasing voltage is obtained from the developing current by grounding the conductive sleeve through a resistance or a capacitor. According to such method, however, it was hard to obtain a correct self-biasing voltage corresponding to the actual picture owing to the electric resistance of the conductive sleeve and its supporting parts or the influence of the sleeve floating capacity.

The objects of this invention are:

1. To obtain a visual picture free of nonuniformity of development and fog;
2. To deposit toner on the electrostatic latent image by dint of stabilized electrostatic attraction;
3. To allow easy control of the toner deposition;
4. To allow obtainment of a stabilized picture irrespective of change of ambient temperature; and
5. To provide a developing apparatus whereby it is possible to broaden the scope of the image forming conditions for forming an electrostatic latent image capable of providing a high-quality picture and to facilitate such image forming operations.

These objects of the invention can be accomplished by using the electrostatic developing method and apparatus therefor according to this invention in which the electroconductive magnetic toner particles are adhered to the insulating carrier and brought close to an electrostatic latent image bearing medium such as an electrostatically charged sensitive plate or sensitive paper so as to form a magnetic brush with said toner particles in close proximity to the sensitive plate, and the toner particles are attracted to the charges on the sensitive plate by means of the electrostatic charges on said electrostatic latent image bearing medium so that said toner particles are properly deposited on the sensitive plate. A bias voltage may be applied between the toner and the electrostatic latent image. Also, electric conduction may be established between the toner and the conductive base of the sensitive plate, or the toner may be simply grounded without such conduction.

It is also possible with the device of this invention to carry out development with no grounding.

Figure 1:
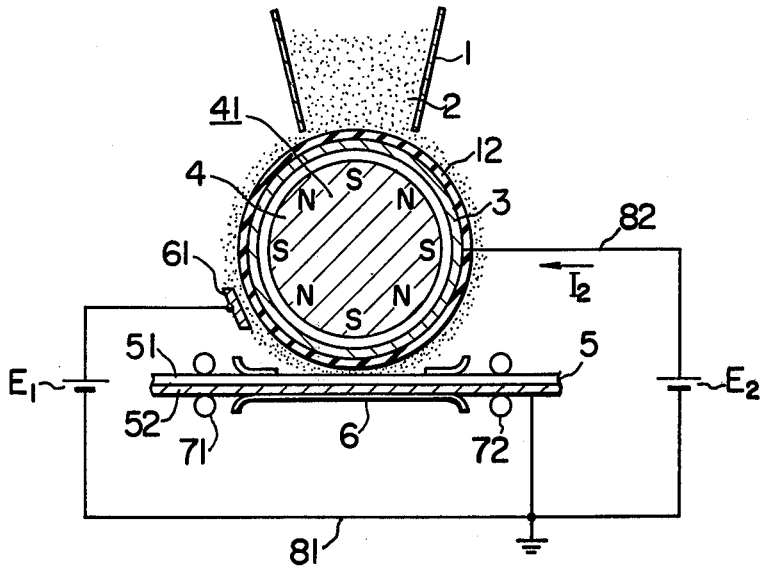
FIG. 1 is a sectional view of a developing apparatus according to the present invention.

Referring first to FIG. 1, there is shown a first embodiment of this invention. In the drawing, reference numeral 1 indicates a toner container in which magnetic toner 2 is contained. This magnetic toner is of the type prepared by mixing magnetic particles, a colorant, an electroconductivity regulator, resin and/or other additives and subjecting the mixture to the kneading, drying, pulverizing and spheroidizing treatments in that order to form the particles with diameter of 5 to 30$\mu$ and electroconductivity of $10^{-2}$ to $10^{-19}$ $\Omega$-cm. Said toner container 1 is open at its bottom, and an insulating sleeve 12 sheathing a conductive sleeve 3 is provided below and confronting the bottom opening of said toner container. Disposed in and concentrically with said sleeve 12 is a permanent magnet 4 of which the external surface is magnetized to present a number of magnetic poles along the circumference. Magnet 4 and sleeves 3 and 4 constitute magnet roll 41. The magnetic toner 2 supplied from the bottom opening of the toner container 1 is carried in the form of a layer along the surface of said sleeve 12 as said sleeve 12 and magnet roll 4 rotate relative to each other. Numeral 5 refers to an electrostatic latent image bearing medium which is driven by rollers 71, 72 and guided by a guide 6 such that the electrostatic latent image side contacts lightly with the layer of magnetic toner 2. The electrostatic latent image on the image bearing side of said medium 5 may be formed directly according to a conventional electrophotography. In this embodiment, the electrostatic latent image bearing medium 5 is a sensitive plate consisting of an electroconductive base 52 and a photoconductive layer 51. In case of using a decalcomania process, it is advantageous to employ a plate in which an insulating layer is laminated on the photoconductive layer 51.

Now the operations of the device of this invention are described in conjunction with the foregoing embodiment where the electrostatic latent image bearing medium is a sensitive plate.

The toner particles 2 built up on the sleeve 2 by magnetic attraction of the permanent magnet 4 are carried down close to the sensitive plate 5 with the rotation of said permanent magnet 4 or sleeve 12. Upon arriving above the magnetic poles along the circumference of the magnet roll 41 composed of said permanent magnet 4 and sleeve 12, the toner particles 2 rise up in the form of a brush on the sleeve 12 under the magnetic lines of force. In case the permanent magnet 4 is fixed and the sleeve 12 rotates, one of the magnetic poles is usually opposed to the sensitive plate 5 or positioned close to said plate 5. In case the permanent magnet 4 rotates, the magnetic poles pass successively over the sensitive plate 5 with the rotation of said magnet 4. In case where $E_1=0$, the tip of the toner brush comes to bear the electrostatic charges of a polarity opposite to that of the latent image charges under the influence of the electric field of said latent image charges on the sensitive plate 5 in accordance as the toner brush formed on the magnetic poles approaches the sensitive plate 5. If electric resistance of the toner particles is approximate to $10^3$ $\Omega$-cm, the electric charges of the opposite polarity to that of the electrostatic latent image are induced in the toner particles which have approached the electrostatic latent image. Consequently, an electric current flows through the toner particles and an electrode plate 61, causing the charged particles to deposit on the latent image surface to produce a visible image. On the other hand, in case electric resistance of the toner particles is approximately $10^{12}$ $\Omega$-cm, it is considered that the toner particles themselves undergo dielectric polarization to develop an electrostatic attraction between the toner particles and the latent image, and such force finally overwhelms the magnetic attraction acting to attach the toner particles on the sleeve 12, with the result that the toner particles are forced away from the magnetic brush to remove onto the sensitive plate 5 and are selectively deposited on the charged part of the latent image. For intensifying dielectric polarization, it is advisable to employ a polar resin or to contain a strong dielectric such as $BaTiO_3$ in the toner.

The construction of the conductive path 81 exerts a great influence to deposition of the toner particles 2 on the electrostatic latent image, so that such conductive path should be as simplified as possible. It is also essential to avoid change of electric contact resistance and other variable factors, and for this reason, no rotary object should be included in the construction of said conductive path.

The sleeve 3 may be utilized as an electrode plate and a D.C. bias voltage $E_2$ may be applied thereto. In this case, it is desirable to make arrangement such that the bias voltage $E_2$ will be applied to the contact developing portion from the surface of the sleeve 3 through the magnetic toner layer (laid on the insulating sleeve 12). This arrangement permits stabilized application of the bias voltage $E_2$ owing to resistivity of the toner layer. It is possible to adjust the toner build-up by changing $E_2$. The insulating sleeve may be made of a plastic material which is easily available. It is desirable that the volume resistance of such sleeve is greater than that of the toner, but if it is not lower than $10^2$ $\Omega$-cm, the sleeve can well serve for the purpose of this invention. It is, however, generally desirable that such volume resistance is higher than $10^7$ $\Omega$-cm. The insulating sleeve may be provided by coating an aluminum-made sleeve with an oxidized alumina film.

As for electric resistance of the toner, it is necessary for proper polarization of the toner brush that the toner has a relatively high electroconductivity equivalent to $10^2$ to $10^5$ $\Omega$-cm in terms of volume resistance as measured in the D.C. electric field of 100 V/cm. Such electric resistance of the toner was measured by filling a 1 cm long and 1 $cm^2$-cross-sectional-area cylinder with the toner and applying a D.C. electric field across both ends of the cylinder.

It is desirable to lower the electric resistance of toner for high speed developing. For example, the desirable electric resistance value of toner is respectively $10^5$ $\Omega$-cm, $10^3$ $\Omega$-cm and $10^2$ $\Omega$-cm for the sensitive paper speed 150 mm/sec, 200 mm/sec, and 250 mm/sec.

On the other hand, high electric resistance toner is desirable for plain paper copy (PPC) because the lower electric resistance toner cannot be transfered to a plain paper from the sensitive plate with an electrostatical method.

Since the developing current $I_2$ flows only through the magnetic toner layer, with the conductive sleeve 3 serving as an electrode at one end, the self-biasing voltage obtained in the developing station (contact section) is determined from resistivity of the magnetic toner layer and developing current $I_2$. In this case, since the sleeve 12 is an insulator, it is possible to eliminate the influence by induction voltage induced by relative rotation of the sleeve 12 with the magnet 4. Also, as the conductive sleeve 3 is coated with the insulator 12, the chance of expansion or contraction of the sleeve due to change of ambient temperature is reduced to minimize the possibility of causing a change in distance between the sensitive plate and the sleeve 12. The risk of corrosion of the sleeve 3 is also eliminated.

In the embodiment described above and shown in FIG. 1, application of bias voltage to the respective parts is performed directly, but such voltage application may be performed through the medium of a capacitor, resistance or such to obtain the similar effect. Also, the electrode plate 61 used in the device may be single or in plurality. Although it is desirable to form the conductive path 81 in case electric resistance of the toner is low (for example $10^5$–$10^7$ Ω-cm), no such conductive path is required when electric resistance of the toner is high or extremely low. Also, the conductive path 82 is not needed when no bias voltage $E_2$ is applied.

Now, an example of actually developing an electrostatic latent image by using the apparatus shown in FIG. 1 is described. First, the plastic-made toner box 1 was filled with a toner composition 2 (consisting of 10 parts of $BaTiO_3$, 45 parts of resin, 40 parts of $Fe_3O_4$ and 5 parts of carbon black and having electric resistance of $10^{11}$ Ω-cm). Then the toner 2 was supplied onto a magnetic roll 41 comprising a columnar permanent magnet 4 and an encompassing aluminum-made conductive sleeve 3 coated with a 1 mm thick plastic-made sleeve 12. The toner particles were carried by this magnetic roll 41 downwardly to contact with a zinc oxide-resin type sensitive plate 5 which is commercially available and so designed that, after overall charging, the electrostatic charges will remain only on the image portion by dint of partial exposure. The surface potential of said sensitive plate 5 was −500 V at the image portion and −50 V at the non-image portion. Voltage $E_2$ may be changed optionally according to the picture to be copied. Voltage $E_1$ was set at 0 to form a conductive path 81 which was grounded. The thus developed visual image on the sensitive plate 5 was subjected to normal pressure fixation to obtain a clear picture with resolution of 10 lines/mm.

A similar test was conducted by using a toner of a different composition. The toner used in this test was prepared by mixing 45 parts of resin, 50 parts of $Fe_3O_4$ and 5 parts of carbon black and coating the nuclear particles with carbon black, and it has electric resistance of $10^3$ Ω-cm. Development by use of these toner particles under the conditions of $E_1=150$ V and $E_2=0$ produced a distinct picture free of nonuniformity of development. Resolution of the picture after pressure fixation was 8.6 lines/mm.

In this invention, we can obtain a copy without forming discharge spots even if $E_2$ is raised to 500 V for a special object. Otherwise we can not obtain a copy without discharge spots in conventional methods in such case.

Figure 2:
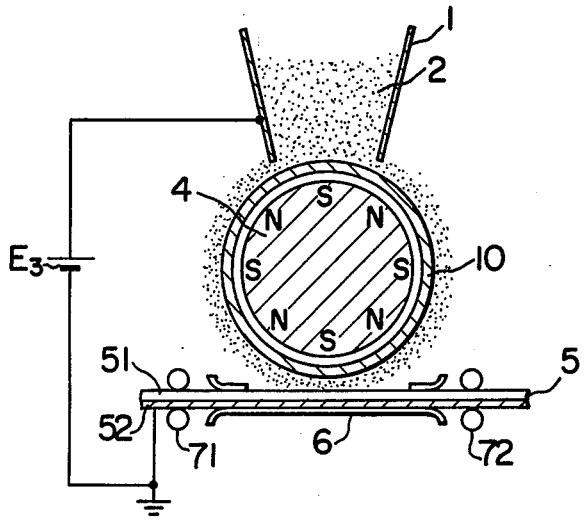
FIG. 2 is a sectional view of another embodiment of the developing apparatus according to this invention.

Referring now to FIG. 2, there is shown a second embodiment of this invention. In FIG. 2, the same reference numerals as in FIG. 1 are used, where possible, to designate the parts corresponding to those in FIG. 1.

In this embodiment, the toner container 1 is made conductive and a D.C. bias voltage is applied to this container to let the developing current flow through the toner. According to this method, it is possible to obtain a correct self-biasing voltage corresponding to the actual picture without receiving any influence of electric resistances of the sleeve 10 and their supporting parts and the sleeve floating capacity. It is also possible to design the toner container 1 so as to act as an insulator while providing an electrode of any suitable configuration at any suitable position in the toner container so as to contact with the toner particles 2, with a D.C. biasing voltage being applied to this electrode to flow the developing current through the toner.

Figure 3:
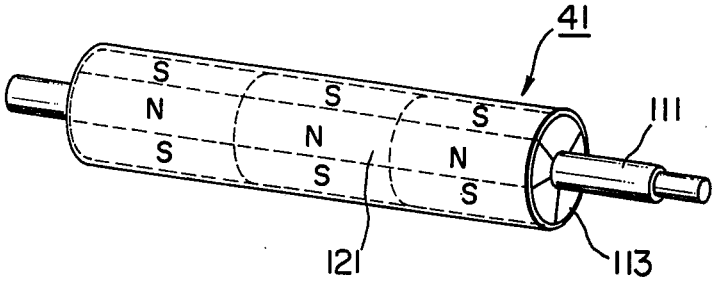
FIG. 3 is a perspective view showing a modification of the magnet roll used in the apparatus of this invention.

FIG. 3 shows a modified form of magnet roll 41 used in this invention. It will be noted that several pieces of permanent magnets 121 are assembled integrally by an insulating sleeve 113 and mounted on a soft-iron-made shaft 111. The sleeve 113 was cast from a thermosetting resin by wrapping several pieces of permanent magnets set in a forming machine with an electroconductive film.

Figure 4:
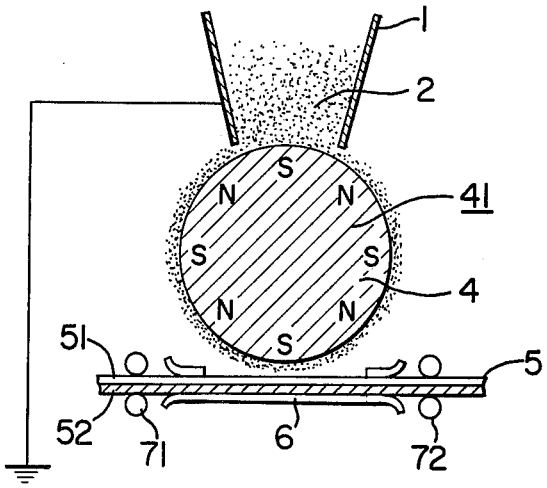
FIG. 4 is a sectional view of another embodiment of the developing apparatus according to this invention.

In still another embodiment of this invention, a single hard ferrite magnet may be used directly as the applicator instead of using a magnet roll having a sleeve integrally formed therewith as in the foregoing embodiment. FIG. 4 shows a third embodiment of this invention. In FIG. 4, the same reference numerals as those in FIG. 1 are used to indicate the parts corresponding to those in FIG. 1. The hard ferrite magnet used in this case may be of any suitable configuration, but usually, a number of axially elongated magnetic poles are provided along the circumference of a columnar magnet and this magnet is rotated about its axis to carry the magnetic toner close to the sensitive plate, whereby the toner brush produced on the magnetic poles can be electrostatically polarized by the latent image on the sensitive plate. As volume resistance of such hard ferrite magnet is high, usually on the order of $10^2$ to $10^6$ Ω-cm, it can well serve as an insulating support.

Figure 5:
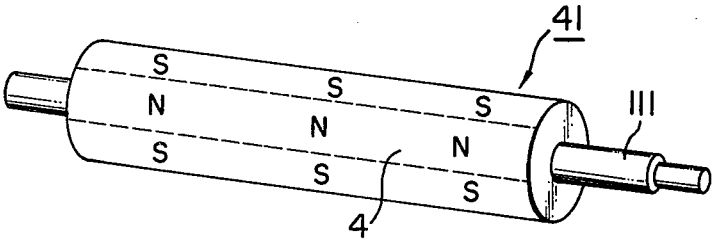
FIG. 5 is a perspective view of the magnet roll used in the apparatus shown in FIG. 4.

It is to be noted that if a joint or juncture is present in any of the magnetic pole portions of the magnet, the toner brush might rise up high at such joint of the magnet, so that it is preferred to use an integral ferrite magnet roll free of any such joint. FIG. 5 shows the perspective view of the magnet roll 41 used in FIG. 4, in which the magnet is an integral cylindrical ferrite magnet having no joints.

In practicing the method of this invention, it is recommendable to previously render the toner neutral electrically by contacting the conductive toner supplied to the applicator with a grounded conductive plate or by grounding the toner reservoir container. This proves helpful to expedite polarization of the toner brush to facilitate toner deposition on the latent image on the sensitive plate.

The toner particles deposited on the sensitive plate are fixed in a suitable way immediately or after having been transferred to other paper. There are available two types of method for fixation: heat fixation where the toner particles carried on the paper are fixed under heating and pressure fixation where a pressure is applied for effecting fixation. These methods may be suitably selected depending on the type of binder or quality of the resin material contained in the toner particles.

In case of using a sensitive medium obtained by depositing a sensitized material on paper, fixation may be performed immediately after development, without undergoing transfer.

In case of performing transfer, it is desirable to charge the toner on the sensitive plate together with the electrostatic latent image to a polarity opposite to that of the transfer paper and then oppose the toner to the transfer paper so that the toner is forcedly attached to the transfer paper by electrostatic attraction.

Such toner transfer may be also accomplished by merely applying a voltage between the toner deposited on the sensitive plate and the transfer paper.

As described above in detail, it is possible with the device of this invention to accomplish uniform development with ease by depositing the electroconductive magnetic toner particles on an insulating carrier and thereby developing the latent image on the sensitive plate. Also, as there is no need of grounding any movable part, the construction of the copying machine can be simplified. Further, according to the present invention, since the bias voltage is applied through resistance of the magnetic toner layer, such voltage application is scarcely affected by the external conditions, and hence there is provided a developing apparatus which is capable of accomplishing very stabilized development.

What is claimed is:

1. An electrostatic developing method comprising the steps of:

(a) attracting magnetic and inductively chargeable electroconductive toner particles which have a volume resistance ranging between $10^2$ and $10^5\Omega$-cm in a D.C. electric-field of 100 V/cm, on an insulating carrier by a magnetic force of a permanent magnet means, (b) carrying the toner particles in brush form on said insulating carrier close to an electrostatic latent image on an electrostatic latent image bearing medium, (c) oppositely charging inductively the tips of the toner particles adjacent to the electrostatic latent image to that of the latent image, an electrode being provided to electrically contact the toner particles and being electrically connected with the image bearing medium, and (d) attracting a part of the toner particles adjacent to the electrostatic latent image by means of an electric attraction force between the toner particles and the latent image.

2. An electrostatic developing method according to claim 1, wherein the permanent magnet means and the insulating carrier are rotated relative to each other for carrying the toner particles.

3. An electrostatic developing method according to claim 1, wherein a voltage differential between the electrode and the medium are impressed during the development.

4. An electrostatic developing method according to claim 2, wherein the permanent magnet means and the insulating carrier are rotated in the same direction for carrying the toner particles.

5. An electrostatic developing method according to claim 1, wherein the magnet means comprises a magnet roll and an insulating plastic sleeve disposed around the magnet roll is used as the insulating carrier.

6. An electrostatic developing method according to claim 5 wherein said magnet roll and said insulating plastic sleeve are arranged to rotate relatively to each other.

7. An electrostatic developing method according to claim 1, wherein a voltage is applied between the magnetic toner and the electrostatic latent image.

8. An electrostatic developing method according to claim 1, wherein the insulating carrier is a ferrite magnet.

9. An electrostatic developing method according to claim 1, wherein no joint is present in a magnetic pole portion.

10. An electrostatic developing method according to claim 1, wherein an integral columnar ferrite magnet is used as said carrier.

11. An electrostatic developing method according to claim 1, wherein the volume resistance of the conductive toner is within the range of $10^2$ to $10^4$ $\Omega$-cm.

12. An electrostatic developing method according to claim 1, wherein the volume resistance of the carrier is greater than that of the conductive toner.

13. An electrostatic developing method according to claim 12, wherein electric resistance of the carrier is higher than $10^7$ $\Omega$-cm.

14. An electrostatic developing method according to claim 13, wherein the conductive toner is previously rendered neutral electrostatically.

* * * * *